US010148026B2

(12) United States Patent
Pape

(10) Patent No.: US 10,148,026 B2
(45) Date of Patent: Dec. 4, 2018

(54) SLIDING ELEMENT FOR CONTACTING PRINTED CIRCUIT BOARDS

(71) Applicant: HARTING Electronics GmbH, Espelkamp (DE)

(72) Inventor: Günter Pape, Enger (DE)

(73) Assignee: HARTING Electronics GmbH, Espelkamp (DE)

( * ) Notice: Subject to any disclaimer, the term of this patent is extended or adjusted under 35 U.S.C. 154(b) by 0 days.

(21) Appl. No.: 15/579,799

(22) PCT Filed: Jun. 27, 2016

(86) PCT No.: PCT/DE2016/100289
§ 371 (c)(1),
(2) Date: Dec. 5, 2017

(87) PCT Pub. No.: WO2017/000936
PCT Pub. Date: Jan. 5, 2017

(65) Prior Publication Data
US 2018/0166808 A1 Jun. 14, 2018

(30) Foreign Application Priority Data
Jun. 30, 2015 (DE) ..... 10 2015 110 498

(51) Int. Cl.
*H01R 12/71* (2011.01)
*H01R 12/52* (2011.01)
(Continued)

(52) U.S. Cl.
CPC ..... *H01R 12/714* (2013.01); *H01R 12/52* (2013.01); *H01R 12/57* (2013.01); *H01R 12/89* (2013.01);
(Continued)

(58) Field of Classification Search
CPC ..... H01R 13/245; H01R 12/714
See application file for complete search history.

(56) References Cited

U.S. PATENT DOCUMENTS 3,215,968 A * 11/1965 Herrmann ..... H01R 12/7082 439/629
3,270,311 A * 8/1966 Deer ..... H05K 7/1417 439/65
(Continued)

FOREIGN PATENT DOCUMENTS

DE 1 245 454 A 7/1967
EP 1 898 497 A2 3/2008

OTHER PUBLICATIONS

International Preliminary Report on Patentability, dated Jan. 2, 2018, for International Application No. PCT/DE2016/100289, 6 pages. (English Translation).
(Continued)

*Primary Examiner* — James Harvey
(74) *Attorney, Agent, or Firm* — Seed IP Law Group LLP

(57) ABSTRACT

A sliding element for electrically contacting conductor paths on two facing printed circuit boards is provided. The sliding element comprises a main body, at least one electrical contact element, and a through-going opening provided for accepting a threaded stud. An internal thread in the through-going opening allows the sliding element to move linearly along the threaded stud when the threaded stud is rotated. By moving the sliding element along the threaded stud, different conductor paths on the printed circuit boards are brought into electrical contact with one another.

12 Claims, 2 Drawing Sheets

(51) Int. Cl.
*H01R 12/57* (2011.01)
*H01R 13/24* (2006.01)
*H01R 12/89* (2011.01)

(52) U.S. Cl.
CPC ..... *H01R 13/24* (2013.01); *H01R 13/245* (2013.01); *H01R 13/2435* (2013.01)

(56) References Cited

U.S. PATENT DOCUMENTS 4,664,458 A 5/1987 Worth
5,498,166 A * 3/1996 Rothenberger .... H01R 13/5202 439/66
5,957,703 A 9/1999 Arai et al.
5,975,914 A * 11/1999 Uchida ..... H01R 13/2435 439/66
7,427,203 B2 * 9/2008 Liao ..... H01R 12/57 439/66
7,950,933 B1 * 5/2011 Harlan ..... H01R 12/7082 439/591
9,225,121 B2 * 12/2015 Chang ..... H01R 13/6585
2001/0049206 A1 * 12/2001 Johnescu ..... H01R 13/2442 439/66
2002/0028588 A1 * 3/2002 Watanabe ..... H01R 12/721 439/62
2003/0143873 A1 * 7/2003 Burmeister ..... H01R 12/79 439/74
2013/0183872 A1 7/2013 Florence, Jr. et al.
2014/0349518 A1 * 11/2014 Chang ..... H01R 13/6585 439/607.01
2014/0377992 A1 * 12/2014 Chang ..... H01R 13/6594 439/607.1

OTHER PUBLICATIONS

German Office Action, dated Jun. 7, 2016, for German Application No. 10 2015 110 498.9, 4 pages.
International Search Report and Written Opinion, dated Oct. 13, 2016, for International Application No. PCT/DE2016/100289, 10 pages. (with English Translation of Search Report).

* cited by examiner

SLIDING ELEMENT FOR CONTACTING PRINTED CIRCUIT BOARDS

BACKGROUND

Technical Field

This disclosure relates to a sliding element for contacting printed circuit boards.

Description of the Related Art

Sliding elements for contacting printed circuit boards are required in order to provide electrical contact between conducting tracks of printed circuit boards that are arranged one above the other and are aligned in parallel with one another. The printed circuit boards are arranged with narrow spacings between one another and comprise a multiplicity of conducting tracks which need to make contact with one another in different ways depending upon the application and the circuitry.

It is possible depending upon the application to connect multiple conducting tracks of printed circuit boards simultaneously by multiple sliding elements. By virtue of displacing (sliding) the sliding elements between the printed circuit boards, it is possible to achieve different positions and thus to close different electrical connections and switching circuits. The sliding element makes electrical contact with the two printed circuit boards that are arranged respectively on each side of said sliding element. As a result, an electrical connection is produced between the conducting tracks of one printed circuit board and the conducting tracks of the other printed circuit board.

It is not expedient in the case of applications of this type, for example in a distribution box for telephone lines, for the wiring and cabling to be of a permanent nature since from time to time the electrical connections need to changed, replaced and new wiring and cabling provided. Conventional cabling arrangements using plug-type connectors and cables are very costly for such procedures. Each time a change is made, it is necessary to remove a cable and to add and electrically connect a cable at another site. In order to carry out this work, it is necessary for an employee to be on-site and to drive to the corresponding distribution box and manually fit the new cabling. This is very time-consuming and cost-intensive.

A further disadvantage of known cabling arrangements is the requirement for a large amount of installation space. Since the cabling arrangement is actuated manually, a switching cabinet of this type requires for each possible connection position a plug-type connector or at least one connection point for the stranded wires. These are very large in comparison to the actual electrical lines that are to be connected to one another. Consequently, a manual cabling procedure requires considerably more installation space than would be required for the actual electrical contact arrangement.

BRIEF SUMMARY

Embodiments of the present invention provide a device for contacting two printed circuit boards. It is to be possible to move the device in a variable manner between the printed circuit boards and thus to connect and provide contact between different conducting tracks that are provided on the printed circuit boards. Moreover, it is to be possible to produce the device in a cost-effective manner and to install said device without a high expenditure of labor. In addition, it would be of advantage if the device is low-maintenance and not sensitive to malfunctions.

Embodiments of the invention relate to a sliding element for electrical contacting conducting tracks of opposite-lying printed circuit boards. Two printed circuit boards are arranged in parallel with one another with a small spacing between the two. Electrical conductor tracks are provided on the printed circuit boards in each case on the face that is facing the other printed circuit board. Depending upon the application and the manner in which the two printed circuit boards are connected to one another, different conducting tracks that are provided on the printed circuit boards and lie opposite one another must be connected to one another in an electrical manner. The sliding element in accordance with embodiments of the present invention is provided so as to connect such conducting tracks of opposing printed circuit boards in a particularly cost-effective and efficient manner.

According to embodiments of the present invention, the sliding element comprises a base body that is produced from an electrically non-conductive material. Polymers are such materials since these have a particularly good electrically insulating effect. The base body of the sliding element is provided so as to receive at least one electrical contact element.

It is advantageous if the electrical contact element is received and fastened in the base body. The base body comprises receiving arrangements for this purpose. The receiving arrangements can be configured for example as a slot. A contact element can be inserted into the slot. In so doing, it is necessary for the receiving arrangement to be configured in such a manner that it is open on the two opposite-lying sides of the base body. As a consequence, it is ensured that each of the two opposite-lying sides of the contact element can make contact in an electrical manner with a printed circuit board.

In one advantageous embodiment, two receiving arrangements are provided in the base body and said receiving arrangements are used to receive two contact elements. It is thus possible to configure the base body and the sliding element in a symmetrical manner.

The contact element is configured as a spring element and is preferably produced from a spring-elastic material. The contact element forms two contact limbs that can hold said contact element in the base body. Depending upon the embodiment, it is also possible to form fastening lugs directly on the contact limbs and said fastening lugs render it possible to improve the manner in which the contact element is held in the receiving arrangement of the base body.

Furthermore, two spring arms are formed directly on the contact element. The spring arms protrude in the direction of the two printed circuit boards outside the base body. The spring arms form in each case a contact site outside the base body. The contact site is provided so as to make contact with the conducting tracks on the printed circuit boards.

In one advantageous embodiment, the spring arms are configured in an S-shaped manner. The S-shaped design of said spring arms means that they are particularly advantageously resilient, as a result of which the contact site can be pressed with sufficient force against the conducting track of the printed circuit board.

In accordance with embodiments of the present invention, the base body comprises a through-going opening. This through-going opening leads through the entire base body. A thread is arranged on the inner face of the through-going opening. The thread that is configured as an inner thread can be provided in different manners in the through-going opening.

In a cost-effective embodiment, the inner thread is formed as one directly in the base body. Since said base body is produced from a polymer, it is possible to form a thread directly therein. Depending upon the material used to produce the base body, the thread is configured so as to withstand higher or not so high loadings.

One preferred embodiment provides to insert a threaded bushing in the through-going opening of the base body. A threaded bushing that is preferably produced from metal is inserted axially into the through-going opening and forms an integral component of the through-going opening. For this purpose, the threaded bushing comprises on its outer face a knurling that is pressed into the through-going opening. As a consequence, it is ensured that the threaded bushing is held securely in the sliding element.

BRIEF DESCRIPTION OF THE SEVERAL VIEWS OF THE DRAWINGS

An exemplary embodiment of the invention is illustrated in the drawings and further explained hereinunder. In the drawings.

DETAILED DESCRIPTION

Figure 1:
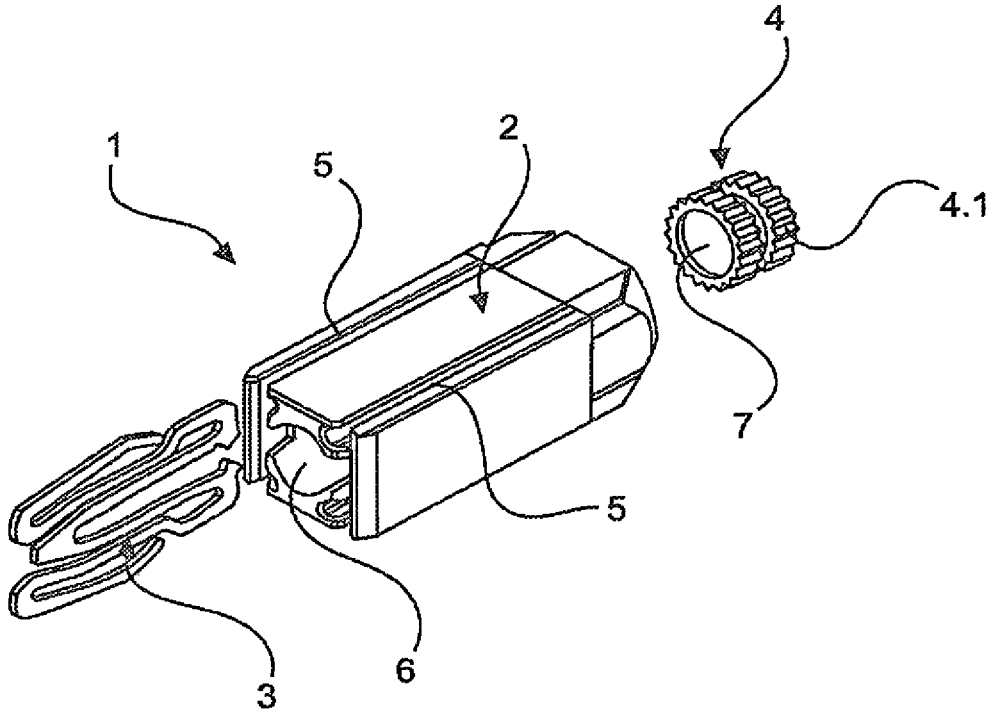
FIG. 1 illustrates an exploded view of a sliding element in accordance with an embodiment of the invention.

The figures comprise in part simplified schematic illustrations. In part, identical reference numerals are used for elements that are similar but possibly not identical. Different views of similar elements can be scaled differently.

FIG. 1 illustrates a sliding element 1 in a spatial exploded view. The sliding element 1 comprises a base body 2, a threaded bushing 4 and two contact elements 3. For the sake of the overview, only one of the contact elements 3 is shown.

The base body 2 of the sliding element 1 has an elongated shape and an approximately square cross section. A through-going opening 6 extends through the entire base body 2. The through-going opening 6 is provided so as to receive a threaded rod 11.

The threaded bushing 4 is provided on one end of the through-going opening 6, in this case the end illustrated on the right-hand side. The threaded bushing 4 comprises on its outer face a knurling 4.1. The knurling 4.1 is provided so as to press the threaded bushing 4 into the through-going opening 6 of the base body 2. By virtue of pressing the threaded bushing 4 into the base body 2, said threaded bushing 4 is held and fixed in said base body 2.

An inner thread 7 is provided on the inner face of the annular threaded bushing 4. The inner thread 7 is used so as to receive a threaded rod 11 and it is possible by rotating the threaded rod 11 to move the sliding element 1 along said threaded rod 11. It is possible in a further embodiment to omit the threaded bushing 4 and the inner thread 7 can be configured as an integral component of the through-going opening 6.

An advantage of using the threaded bushing 4 is however that this is far less sensitive to wear than a thread that is formed as one in the base body 2. As a result of the better material characteristics of a threaded bushing 4 (e.g., a threaded metal sleeve), it is possible to use the thread for a longer period of time and more frequently with considerably fewer signs of wear.

Two receiving arrangements 5 are formed on the face of the base body 2 that lies opposite the threaded bushing 4. The receiving arrangements 5 that are configured as slots extend from the end face of the base body 2 over almost the entire length of the base body 2. The receiving arrangements 5 are provided so as to receive in each case a contact element 3. For the sake of the overview, FIG. 1 illustrates only one of the two contact elements 3.

Figure 2:
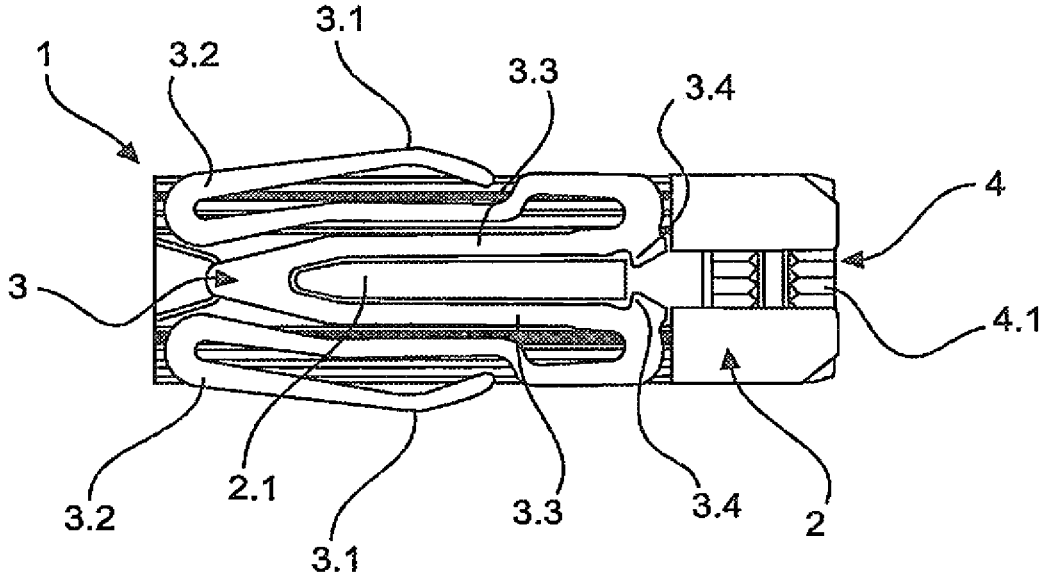
FIG. 2 illustrates a sectional view of a sliding element in accordance with an embodiment of the invention.

In accordance with the illustrated embodiment of FIG. 1, the receiving arrangements 5 extend from the lower face (not illustrated in the figure) of the base body 2 as far as the illustrated upper face of the base body 2. FIG. 2 illustrates in detail a sectional view through one of the receiving arrangements 5 showing a contact element 3 received in said receiving arrangement 5.

The sectional view in FIG. 2 extends along one of the receiving arrangements 5. The receiving arrangement 5 in the base body 2 is configured on three sides in an open manner. On the illustrated upper face, and also on the lower face, the contact element 3 protrudes in each case out of the receiving arrangement 5 past the outer face of the base body 2. This is used for contacting two printed circuit boards 10 (FIG. 3) that are arranged above and below the sliding element 1.

The opening (illustrated on the left-hand side) of the receiving arrangement 5 is provided for mounting the contact element 3 in the receiving arrangement 5. The contact element 3 can be inserted and latched into the receiving arrangement 5 from the illustrated left-hand side. A latching region 2.1 is provided for this purpose within the receiving arrangement 5.

The latching region 2.1 is arranged as a connecting piece in the receiving arrangement 5 that is configured as a slot. The contact element 3 that is arranged in the middle can grip and latch with both sides of the latching region 2.1. The contact element 3 that is configured in an axis-symmetrical manner comprises for this purpose two contact limbs 3.3 that extend along the latching region 2.1 and said latching region 2.1 is enclosed by the two contact limbs 3.3.

In the left-hand region, the contact limbs 3.3 of the contact element 3 are connected to one another. A fastening lug 3.4 is formed on each contact limb 3.3 on the opposite-lying end (illustrated on the right-hand side) of the contact limb 3.3. This fastening lug 3.4 faces the respective opposite-lying contact limb 3.3. The fastening lugs 3.4 are thus used as latching hooks by way of which the contact element 3 grips around the latching region 2.1. The contact element 3 thus latches on the latching region 2.1 and is consequently secured in the base body 2 of the sliding element 1.

A spring arm 3.2 adjoins a respective contact limb 3.3 of the contact element 3. These spring arms 3.2 are formed in this embodiment in an S-shaped manner. The S-shape produces a particularly advantageous spring travel. A contact site 3.1 is configured respectively at the ends of the spring arms 3.2. The contact sites 3.1 are located outside the housing 2 and can thus each make contact with a respective printed circuit board 10 (FIG. 3) that is arranged above or below the sliding element 1.

In an advantageous embodiment, the contact element 3 is configured as a stamped metal part. A particularly advantageous aspect of this is that said contact element 3 is not bent or produced in multiple planes. The stamping process renders it possible to provide the metal part with very fine contours. A bending process is always very costly and inaccurate. In addition, it is not necessary to reshape the material in a plastic manner during the stamping procedure, as a result of which the contact element 3 retains its strength and flexibility and also resilient characteristics at each site.

In addition, the threaded bushing 4 is also evident in FIG. 2 in the right-hand region. This threaded bushing 4 is pressed into the through-going opening 6 and fixed by the knurling 4.1 on its outer face in the housing 2. By virtue of the threaded bushing 4 and the through-going opening 6, it is possible to guide a threaded rod 11 on which it is possible to move the sliding element 1.

Figure 3:
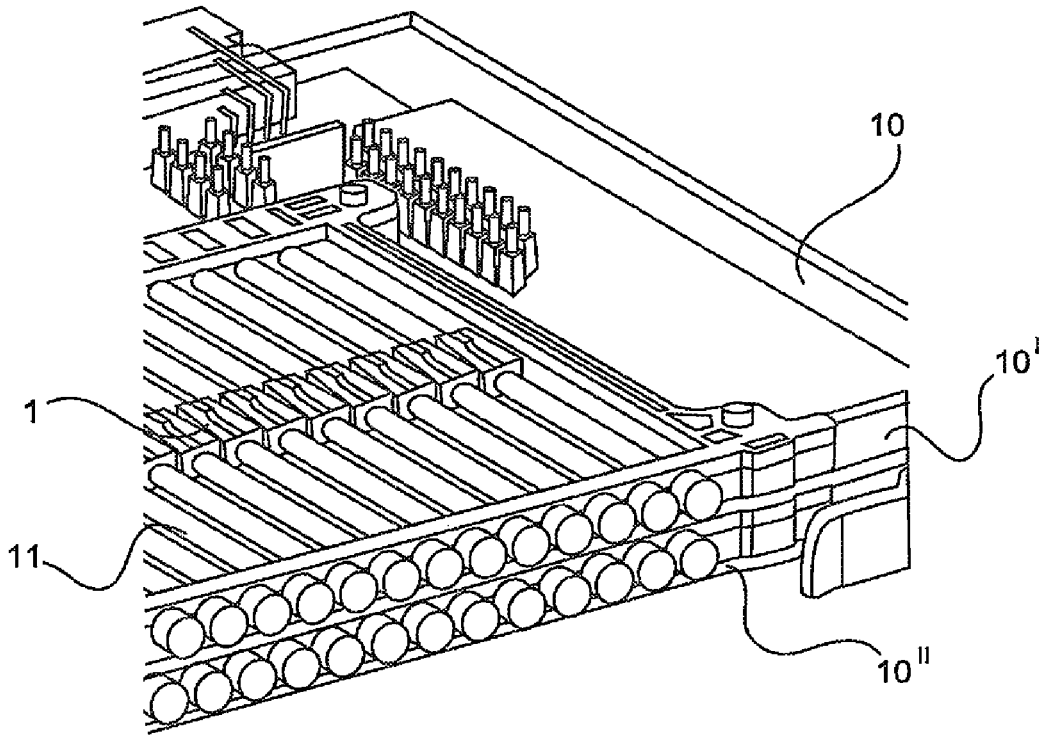
FIG. 3 illustrates a system comprising multiple installed sliding elements.

One application of the system using multiple sliding elements 1 is illustrated in FIG. 3. The system comprises three printed circuit boards 10, 10', 10" that are arranged one above the other. The uppermost printed circuit board 10 is only illustrated schematically so as to facilitate the illustration.

A support frame is arranged in each case between the printed circuit boards 10, 10', 10". The support frame is provided on the one hand as a spacer and so as to fasten the printed circuit boards 10, 10', 10". On the other hand, multiple threaded rods 11 are arranged adjacent to one another in the support frame. Each threaded rod 11 has at the front face a coupling—schematically illustrated in this case as circular—that is used so as to rotate the threaded rod 11.

A sliding element 1 is arranged in each case on the threaded rods 11 that are arranged parallel to one another. These are also illustrated in a schematically simplified manner. The sliding elements 1 can be moved in an axial manner on the respective threaded rod 11 by rotating said threaded rod 11. The contact site 3.1 of the contact elements 3 of the sliding elements 1 can thus make contact with the conducting tracks that are provided on the printed circuit boards 10, 10', 10". An electrical connection is thus provided between the printed circuit boards 10 and 10' or 10' and 10".

Embodiments in accordance with the invention of the sliding elements 1 thus renders possible a cost-effective production process and an installation procedure that does not require a high expenditure of labor. In addition, the device is low-maintenance and not sensitive to malfunctions.

In addition, a system that is configured in accordance with embodiments of the present invention and comprises a multiplicity of sliding elements 1 can be operated in a simple manner by a robot-supported device. A movable motor can thus approach the individual threaded rods 11 one after the other and move the sliding elements 1 by rotation of the threaded rods 11. It is thus possible via a corresponding data connection to actuate different electrical circuits by remote maintenance. It is no longer necessary to use a technician on-site.

In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A sliding element for contacting two printed circuit boards, the sliding element comprising:

a base body; and at least one contact element, wherein the base body is embodied from an electrically insulating material and receives the at least one contact element, wherein the contact element forms contact sites on at least two opposite-lying sides of the base body, said contact sites being located outside the base body, wherein the sliding element includes a through-going opening that extends through the base body of the sliding element, and wherein the through-going opening comprises an inner thread at least in a region.

2. The sliding element as claimed in claim 1, wherein the contact element comprises at least two spring arms, wherein in each case a respective one of the at least two contact sites is arranged on a free end of a respective one of the spring arms.

3. The sliding element as claimed in claim 2, wherein the contact element comprises two contact limbs, and wherein a respective one of the spring arms is formed on each contact limb.

4. The sliding element as claimed in claim 1, wherein the inner thread is arranged in a threaded bushing, and wherein the threaded bushing is arranged in the through-going opening.

5. The sliding element as claimed in claim 4 wherein the threaded bushing comprises a knurling on an outer face thereof and that the knurling engages into the through-going opening of the base body.

6. The sliding element as claimed in claim 1, wherein the base body comprises at least one receiving arrangement so as to receive the at least one contact element.

7. The sliding element as claimed in claim 6, wherein the receiving arrangement is configured as a slot through the base body.

8. The sliding element as claimed in claim 7, wherein the receiving arrangement comprises a latching region for latching the contact element in the receiving arrangement.

9. The sliding element as claimed in claim 3, wherein the two contact limbs encompass a latching region in the base body.

10. The sliding element as claimed in claim 2, wherein each of the spring arms is configured in an approximately S-shaped manner.

11. The sliding element as claimed in claim 9, wherein a respective fastening lug is formed on each contact limb, and wherein the fastening lugs render it possible to secure the contact element on the latching region.

12. The sliding element as claimed in claim 11, wherein the contact element is configured as a stamped, planar metal part.

* * * * *